US008288973B2

(12) United States Patent
Ford

(10) Patent No.: US 8,288,973 B2
(45) Date of Patent: Oct. 16, 2012

(54) TELESCOPING MAST CABLE STORAGE SYSTEM

(75) Inventor: Thomas Davidson Ford, San Diego, CA (US)

(73) Assignee: NS Microwave, Spring Valley, CA (US)

( * ) Notice: Subject to any disclaimer, the term of this patent is extended or adjusted under 35 U.S.C. 154(b) by 335 days.

(21) Appl. No.: 12/657,729

(22) Filed: Jan. 26, 2010

(65) Prior Publication Data

US 2010/0314503 A1 Dec. 16, 2010

Related U.S. Application Data

(63) Continuation-in-part of application No. 12/456,445, filed on Jun. 16, 2009.

(51) Int. Cl.
*H02P 1/00* (2006.01)
*B66C 23/06* (2006.01)

(52) U.S. Cl. ..... 318/277; 318/266; 318/466; 318/468; 52/111; 52/118

(58) Field of Classification Search ..... 318/266, 318/277, 437, 466, 468; 244/158 R; 248/405; 52/111.118; 51/111, 118; 242/378.2, 377; 166/250.1, 66
See application file for complete search history.

(56) References Cited

U.S. PATENT DOCUMENTS 3,648,316 A 3/1972 Habian et al.
4,077,144 A * 3/1978 Smits ..... 40/590
4,516,637 A * 5/1985 Winckler ..... 166/377
4,523,645 A * 6/1985 Moore ..... 166/385
4,815,757 A * 3/1989 Hamilton ..... 280/764.1
4,942,529 A 7/1990 Avitan et al.
4,942,537 A * 7/1990 Verry ..... 703/1
5,557,892 A * 9/1996 Lavin ..... 52/121
5,570,546 A * 11/1996 Butterworth et al. ..... 52/111
5,615,855 A * 4/1997 Marue et al. ..... 248/405
5,850,879 A * 12/1998 Smith ..... 166/250.01
5,963,749 A * 10/1999 Nicholson ..... 396/421
6,046,706 A * 4/2000 Vargas ..... 343/883
6,134,422 A * 10/2000 Bobadilla et al. ..... 455/561
6,338,450 B1 * 1/2002 Schwendinger ..... 242/388.9
RE37,559 E * 2/2002 Marue et al. ..... 248/405
6,460,795 B1 * 10/2002 Brown, Jr. ..... 242/378.2
6,758,321 B2 * 7/2004 Spettl ..... 198/347.1
7,187,150 B2 3/2007 Robb et al.
7,497,140 B2 * 3/2009 Blackwelder et al. ..... 74/89.28
(Continued)

OTHER PUBLICATIONS

PCT/US2010/038900 International Search Report and Written Opinion dated Sep. 7, 2010.

*Primary Examiner* — Paul Ip
(74) *Attorney, Agent, or Firm* — Duane Morris LLP

(57) ABSTRACT

A telescoping mast with a cabling system configured to cover and store cable within the structure of the mast and able to efficiently extend and retract multiple telescoping sections without jar and minimal energy. The telescoping mast has a hollow mast housing. A telescoping section is nested within the interior of the mast housing. A set of upper pulleys affixed to the upper end of the mast housing, while a set of lower pulleys affixed to the lower end of the telescoping section. A cable is threaded through the first upper pulleys and first lower pulleys such that a first end of the cable is attached to the mast housing and the cable remains taut when the telescoping section is raised or lowered.

20 Claims, 6 Drawing Sheets

U.S. PATENT DOCUMENTS

| | | | | |
|---|---|---|---|---|
| 7,654,923 | B2 * | 2/2010 | Bianchi et al. | 474/64 |
| 7,768,473 | B2 * | 8/2010 | Kardohely | 343/883 |
| 7,774,994 | B2 * | 8/2010 | Battaglia | 52/121 |
| 7,966,777 | B2 * | 6/2011 | Douglas et al. | 52/118 |
| 2003/0234601 | A1 * | 12/2003 | Spettl | 312/319.5 |
| 2005/0221963 | A1 * | 10/2005 | Prismall et al. | 482/92 |
| 2007/0028532 | A1 * | 2/2007 | Douglas et al. | 52/118 |
| 2007/0298919 | A1 * | 12/2007 | Bianchi et al. | 474/64 |
| 2008/0236060 | A1 * | 10/2008 | Battaglia | 52/121 |
| 2009/0110527 | A1 * | 4/2009 | Kardohely | 414/567 |
| 2009/0145056 | A1 * | 6/2009 | Pereira | 52/111 |

* cited by examiner

TELESCOPING MAST CABLE STORAGE SYSTEM

RELATED APPLICATIONS

This application is a continuation-in-part of U.S. patent application Ser. No. 12/456,445, entitled "Telescoping Mast," filed on Jun. 16, 2009.

BACKGROUND

1. Field of the Invention

Aspects of the present invention relate in general to cable storage in a retractable telescoping mast. Aspects include a drive mechanism apparatus capable of efficiently storing cable in an extending and retracting the telescoping mast. Further aspects of the invention include an apparatus that spools cable during the extension and retraction of an antenna mast.

2. Description of the Related Art

Telescoping masts of various types have been used in broadcasting and receiving radio messages in many different environments. Included in such developments are telescoping masts, which can be extended vertically or retracted vertically so that they can be mounted on a vehicle and transported to a desired site.

Telescoping masts are frequently used in mobile applications where a radio frequency antenna, temporary cell phone tower, camera, microwave television broadcast antenna or other payloads need to be placed in a position quickly and efficiently.

A mast can be retractable—wherein the mast can be retracted into a storage position in which the mast is relatively short in its overall height dimension. When fully extended or deployed, the overall height is many times larger than its retracted storage height dimension.

Most telescoping masts take a long time to deploy. For example, a four section steel mast might deploy from a 30 foot nested position to a 90 foot deployed position, in about 15 minutes. The energy requirement to move such a heavy and unwieldy mast is also enormous, resulting in the use of expensive motors in a mast drive mechanism.

Faster deploying units require greater power requirements to move the mast, and suffer from even greater problems. Usually the mast payload contains sensitive equipment, which can be damaged if the extension or retraction of the mast is sudden, or results in a jarring movement.

A payload will have electrical requirements. Typically, in such an environment, masts externally route electrical cable to the payload mounted on top of the mast.

SUMMARY

A telescoping mast has a cabling system designed to cover and store cable within the structure of the mast. The telescoping mast has a hollow mast housing. A telescoping section is nested within the interior of the mast housing. A set of upper pulleys affixed to the upper end of the mast housing, while a set of lower pulleys affixed to the lower end of the telescoping section. A cable is threaded through the first upper pulleys and first lower pulleys such that a first end of the cable is attached to the mast housing and the cable remains taut when the telescoping section is raised or lowered.

The mast is able to efficiently extend and retract multiple telescoping sections without jar and minimal energy.

DETAILED DESCRIPTION

One aspect of the present invention includes the understanding that when cable is routed external to the mast, damage to unprotected cable easily occurs due to contact with objects; consequently, embodiments of the present invention route cable (electrical, optical, or any other cable known in the art) internally within the mast. Consequently, embodiments protect cable from external objects and environmental conditions by keeping the cable completely covered and stored within the structure of the mast.

In some embodiments, cable runs from the base of the mast to the payload mounted at the top of the mast. The cable is stored internally within the mast housing by spooling up over a set of pulleys. The pulleys move in relation to the mast height and payout or retract the proper length of cable to match the length of mast extension.

Another aspect of the present invention includes the realization that motors driving a telescoping mast may be supplemented by alternate power sources, and that controlling the motors with a computation unit may be used to eliminate jar in telescoping mast movement, resulting in a "soft landing" at any position.

Additionally, the speed of telescoping masts carrying camera payloads may have additional design considerations. For example, such masts deployed in hostile or combat areas may need to rapidly ascend and descend to avoid enemy fire.

Embodiments of the present invention include an apparatus, method, and computer-readable medium configured to control antenna movement to eliminate jar. Other embodiments of the present invention may include supplemental power sources to assist and reduce the power requirements of an electric motor.

Operation of embodiments of the present invention may be illustrated by example. FIGS. 1A-D depict an example telescoping mast, constructed and operative in accordance with an embodiment of the present invention. Telescoping mast 1000, as shown in FIG. 1A, is a mast assembly extended with telescoping sections 1200A-G. For illustrative purposes only, seven telescoping sections 1200A-G are depicted supporting a payload 1100. It is understood by those known in the art that in embodiments of the present invention may be utilized with any number of telescoping sections 1200. An example mast assembly is U.S. Pat. No. 6,046,706, entitled "Antenna Mast and Method of Using Same." Payload 1100 may be any a radio frequency antenna, temporary cell phone tower antenna, camera, microwave television broadcast antenna or other payload known in the art.

In FIGS. 1A-D, a drive mechanism 2000 is used to power and control the extension and retraction of the mast 1000.

Figure 1B:
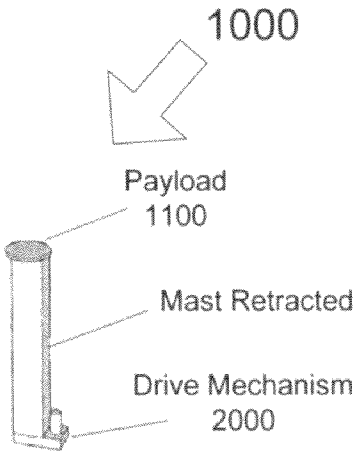
FIGS. 1A-D illustrates an embodiment of a telescoping mast and cabling system deployed in an extended and retracted positions.
Figure 1A:
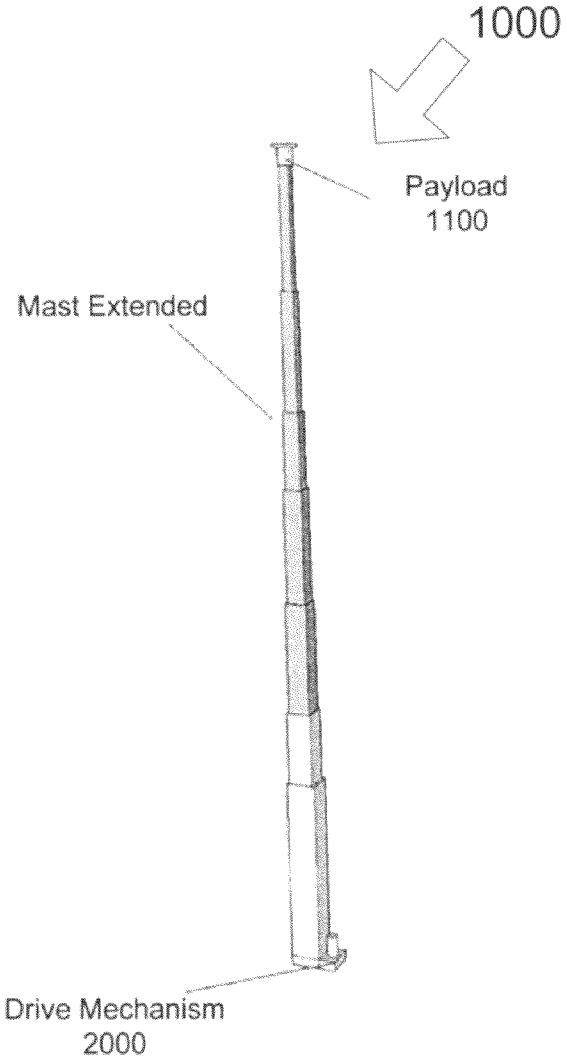

Similarly, FIG. 1B depicts an external view of telescoping mast 1000 in a retracted (or "nested") state.

Figure 1C:
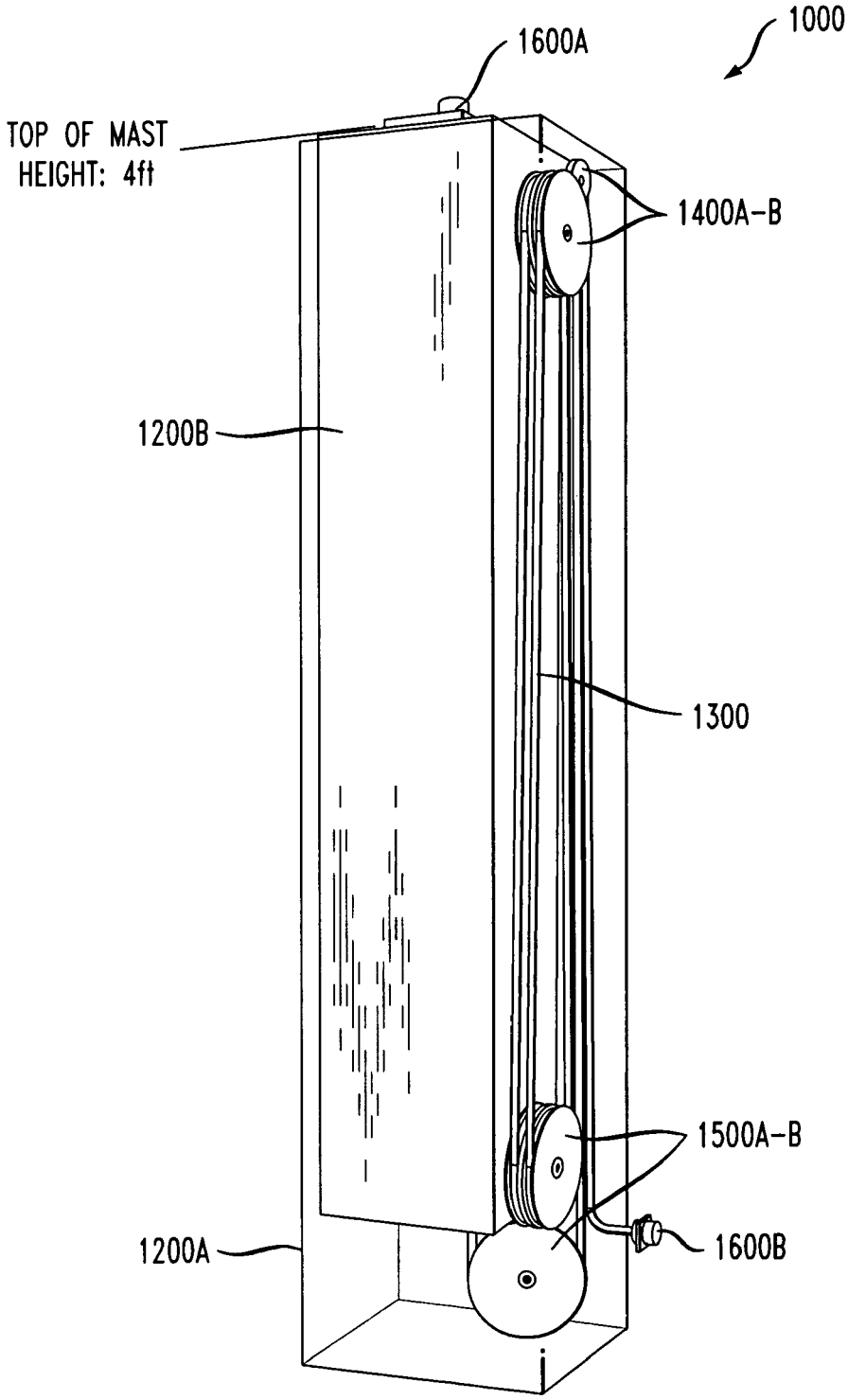
Figure 1D:
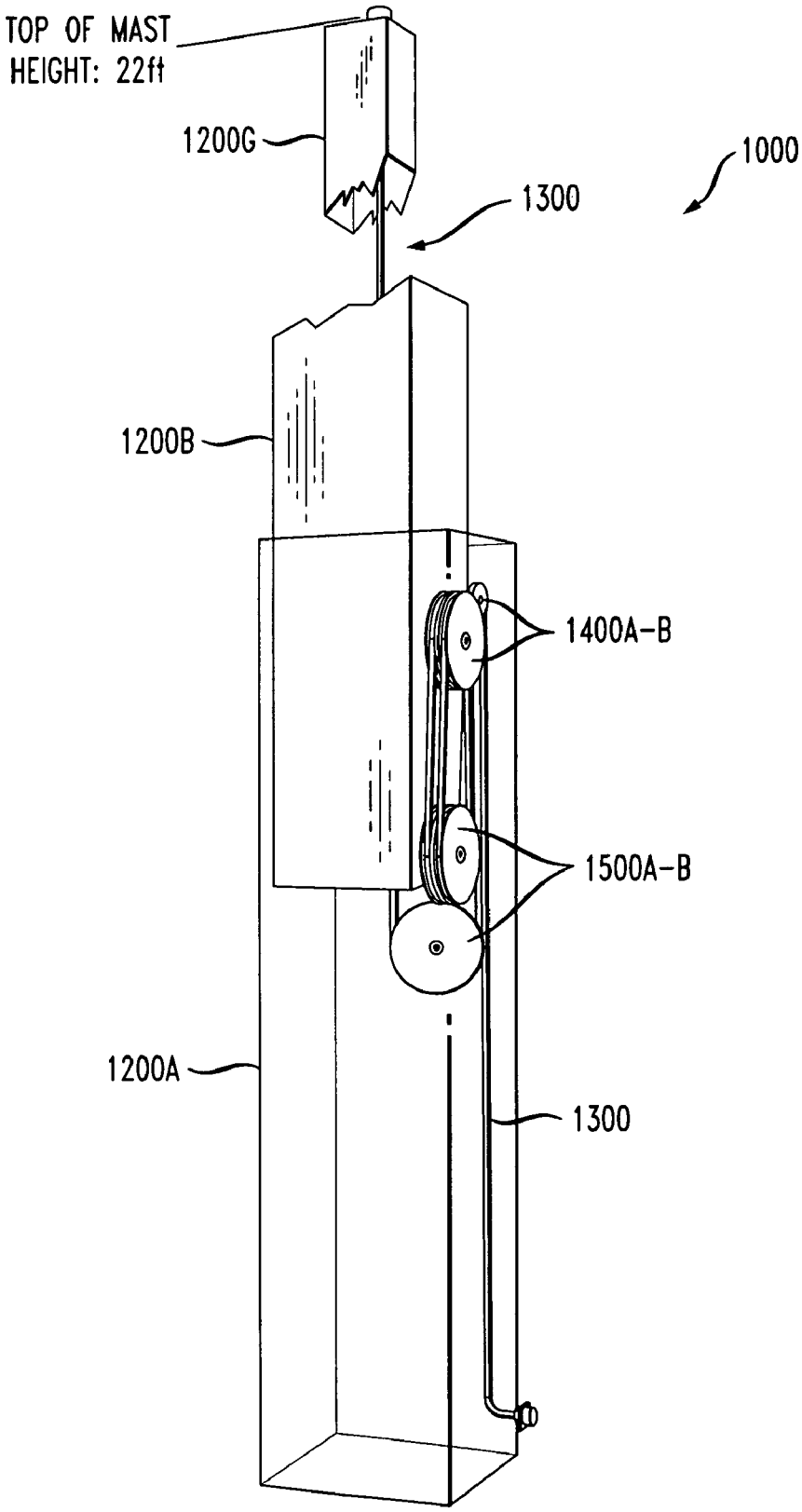

Moving on, we now discuss a cabling system of pulleys within the telescoping mast 1000. FIGS. 1C-D illustrate a system of pulleys within only a single telescoping section.

This example is for illustrative purposes only. It is understood by those known in the art that this concept applies equally to any number of telescoping sections. Furthermore, it is worth noting that multiple cabling systems may be run in parallel to support multiple types of cable. Embodiments may include a separate cabling systems for electrical power, digital or analog video/audio, packetized electronic data, or all of the above.

FIG. 1C illustrates internal features of telescoping mast 1000 in a retracted position. As shown, cable 1300 runs from the base of the mast to the payload 1100 mounted at the top of the mast. The cable is stored internally within the mast housing by spooling up over sets of pulleys, 1400A-B, 1500A-B. The relative position of pulleys 1400A-B and 1500A-B is shown when the mast is in the nested or retracted position. Pulleys 1500A-B are attached near the bottom of largest moving telescoping section 1200B of the mast 1000. The bottom of the largest moving telescoping section 1200B is directly driven vertically by a lead screw, which is further discussed below. The pulleys move in relation to the mast height and payout or retract the proper length of cable to match the length of mast extension. The mast housing may also serve to protect the cable from external elements such as rain, dirt, tree limbs, moving objects or other external elements. Pulleys 1400A-B are attached on the inside and near the top of outer stationary section 1200A of the mast 1000. The outer stationary section 1200A of the mast 1000 may also referred to as the mast housing.

As depicted, cable 1300 is a multi-conductor flexible electrical cable that will move through pulleys 1400A-B and 1500A-B as the mast 1000 is extended and retracted. As understood by one of ordinary skill in the art, other embodiments may use electrical, optical, computer-networking, or any other cable known in the art. Connectors 1600A-B may be attached to either end of the cable 1300, allowing quick electrical/mechanical disconnect of the payload at the top and the control/monitor equipment at the base of the mast 1000.

FIG. 1D depicts the position of pulleys 1400A-B and 1500A-B when mast 1000 is extended. As can be seen, pulleys 1400A-B and 1500A-B are closer together, allowing the stored cable 1300 to pay out for any extended mast height. This system of pulleys 1400A-B and 1500A-B, along with their relative attachment points 1600A-B, keeps the cable 1300 under constant tension whether the mast is fully extended, nested or anywhere in between.

Figure 2:
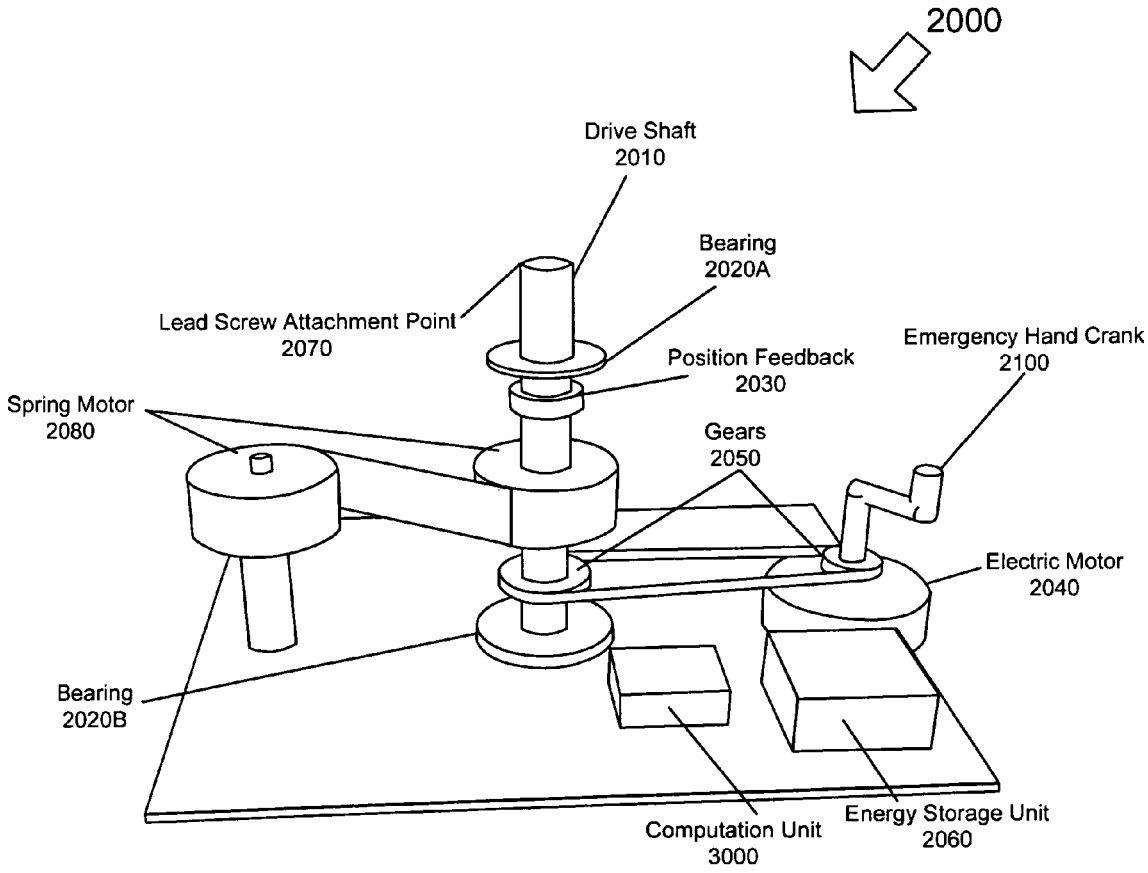
FIG. 2 is a diagram of a telescoping mast drive mechanism used to efficiently extend and retract the telescoping mast.

FIG. 2 illustrates an embodiment of a drive mechanism 2000 controlled by a computation unit 3000, constructed and operative in accordance with an embodiment of the present invention. Drive mechanism 2000 includes a drive shaft 2010 with multiple bearings 2020A-B, coupled to an electric motor 2040 through gears 2050A-B. The drive mechanism 2000 further includes a position feedback sensor 2030, a motor 2040, and a computation unit 3000. In some instances, drive mechanism 2000 may include a crank 2100, to enable manual extension or retraction of the mast 1000.

The drive shaft 2010 itself may be connected to the internal portions of the telescoping sections 1200 via a lead screw attachment point 2070. It is understood that any attachment point 2070 known in the art capable of transferring the motion of drive shaft 2010 to telescoping sections 1200 would be sufficient.

Position feedback sensor 2030 may any sensor known in the art configured to communicate the telescoping mast 1000 position to computation unit 3000. The operation of computation unit 3000 is described below.

Motor 2040 may be any motor known in the art capable of raising or lowering telescoping mast 1000. For illustrative purposes only, motor 2040 is assumed to be an electric motor. The capacity of electric motor 2040 is determined by the mast size. Larger masts require greater horsepower motors. For example, electric motor 2040 could be a ⅛ horsepower DC permanent magnet motor.

Electric motor 2040 may be further supplemented with power from electrical energy storage unit 2060 and/or spring motor 2080.

Electrical energy storage unit 2060 may be any electrical energy storage unit known in the art, including, but not limited to an ultra capacitor or battery. Electrical energy storage unit 2060 provides a "power buffer" between the peak demands of mast (during mast raising and lowering) and the average load on the electric motor 2040. Moreover, electrical energy storage unit 2060 allows telescoping mast 1000 to extend or retract if motor 2040 is inoperable or damaged.

Spring motor 2080 may be any potential energy storage unit known in the art. Spring motor 2080 may assist or replace motor 2040 in extending or retracting mast 1000. Additionally spring motor 2080 is balanced and designed to match the weight and mass of the mast 1000 and its payload 1100.

In some embodiments, spring motor 2080 may be a constructed from a stressed constant force spring, such as B-Motor springs. B-Motor springs provide high amounts of torque in a small package. An example of such a spring motor 2080 is a constant torque motor from Spiroflex Division of the Kern-Liebers Ltd., part of the Kern-Liebers Group of Companies, of Schramberg, Germany. These spring motors 2080 provide rotational energy from the torque output drum, or linear motion with the use of a pulley, cable, or webbing. While it is convenient for the design that the spring motor 2080 to have constant torque, other spring motors known in the art, such as torsion bars, may be equally applicable.

Crank 2100 may be any manual crank known in the art to enable manual extension or retraction of telescoping mast 1000. Crank 2100 allows users to manually extend or retract telescoping mast 1000 when motor 2040 is inoperable. In some instances, energy from crank 2100 may also be stored by spring motor 2080.

Figure 3:
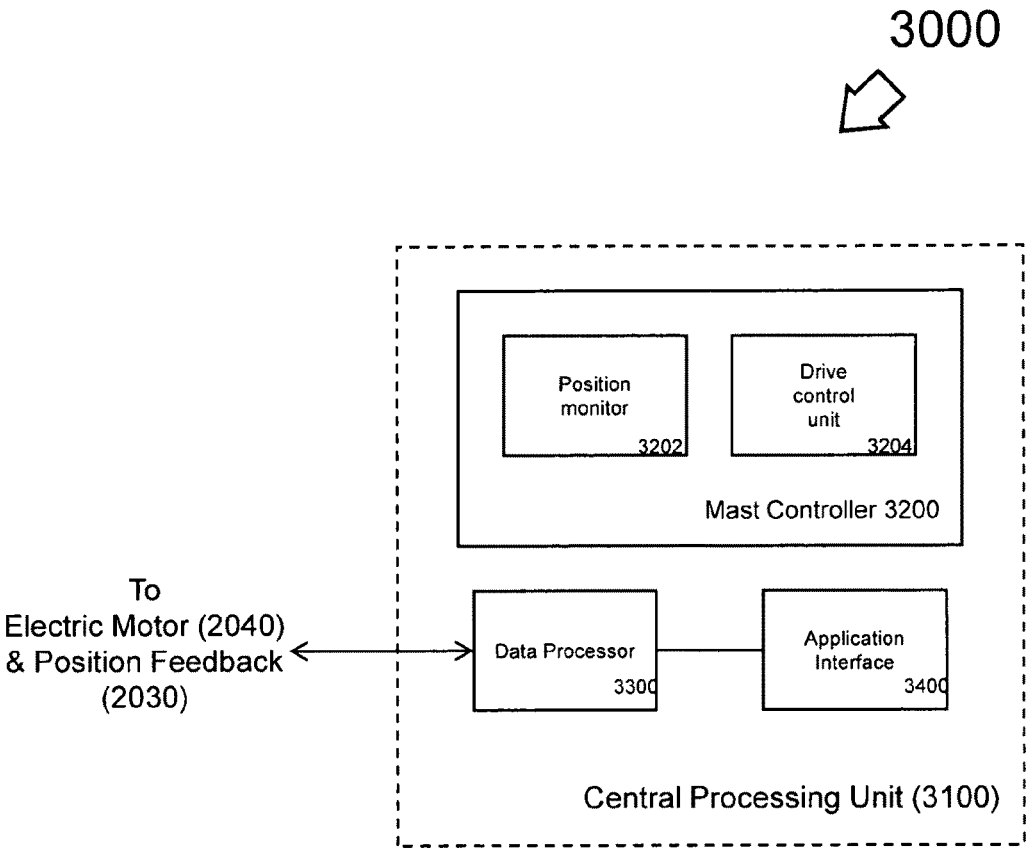
FIG. 3 is a block diagram of a telescoping mast computation unit used to control the drive mechanism.

FIG. 3 depicts a computation unit 3000, constructed and operative in accordance with an embodiment of the present invention. Computation unit 3000 comprises a central processing unit 3100 capable of communicating to electric motor 2040, and position feedback sensor 2030. Computation unit 3000 may run an embedded operating system (OS) and include at least one processor or central processing unit (CPU) 3100. In some alternate embodiments, computation unit 3000 runs a standard non-real-time operating system. Central processing unit 3100 may be any microprocessor or micro-controller as is known in the art.

The software for programming the central processing unit 3100 may be found at a computer-readable storage medium (not shown) or, alternatively, from another location across a communications network. Central processing unit 3100 is connected to computer memory. Computation unit 3000 may be controlled by an operating system that is executed within computer memory.

Storage medium may be a conventional read/write memory such as a magnetic disk drive, floppy disk drive, compact-disk read-only-memory (CD-ROM) drive, digital versatile disk (DVD) drive, flash memory, memory stick, transistor-based memory or other computer-readable memory device as is known in the art for storing and retrieving data.

Turning to the functional elements contained within central processing unit 3100, central processing unit 3100 comprises mast controller 3200, data processor 3300, and application interface 3400. Mast controller 3200 further comprises position monitor 3202 and drive control unit 3204. It is well understood by those in the art, that these functional elements may be implemented in hardware, firmware, or as software instructions and data encoded on a computer-readable storage medium.

Data processor 3300 interfaces with storage medium, electric motor 2040, and position feedback sensor 2030. The data processor 3300 enables mast controller 3200 to locate data on, read data from, and send data to, these components.

Application interface 3400 enables central processing unit 3100 to take some action with respect to a separate software application or entity. For example, application interface 3400 may take the form of a windowing or other user interface, as is commonly known in the art.

The function of position monitor 3202 and drive control unit 3204 are described below.

Figure 4:
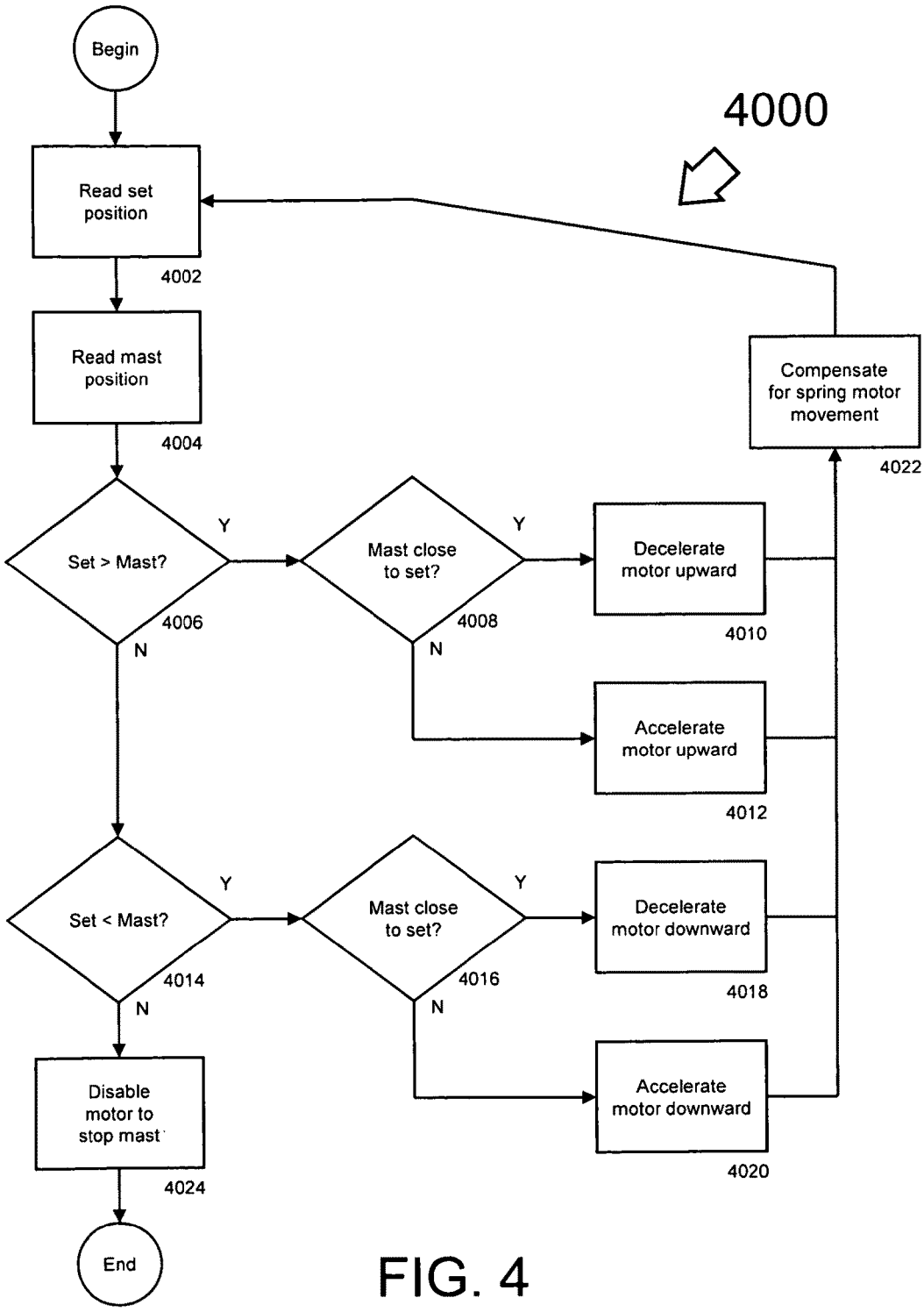
FIG. 4 is a flow chart of a method to control the extension and retraction of a telescoping mast without jar.

FIG. 4 is a flow chart of a process 4000 to control the extension and retraction of a telescoping mast without jar, coming in a smooth stop (also known as a "soft landing") in accordance with an embodiment of the present invention. Soft landings help prevent damage to sensitive payloads 1100, such as cameras, radio-frequency antennas, microwave television broadcast antennas, cellular phone towers, satellite communication dishes, and the like.

Initially, a user sets the desired position of the telescoping mast 1000. In some embodiments, telescoping mast 1000 may simply be set to extended or retracted positions. In other embodiments, variable telescoping mast 1000 heights may be specified, where the height is set in between the fully extended or fully retracted positions. In either case, the application interface 3400 reads the set position at block 4002.

Position monitor 3202 reads the actual (or "current") mast position, block 4004. In some embodiments, the extension and retraction of mast 1000 is measured by resistance or voltage fed into an analog-to-digital converter. In such embodiments, mast position may be indicated as a voltage on a variable resistor or potentiometer.

When the mast set position is greater than the actual position, as determined by mast controller 3200, flow continues at decision block 4008. Otherwise, flow continues at decision block 4014.

At decision block 4008, if the actual mast position is close to the set position, drive control unit 3204 decelerates electric motor upward, block 4010. If the actual mast position is not close to the set position, drive control unit 3204 accelerates electric motor upward, block 4012.

At block 4022, the mast controller 3200 compensates for movement by spring motor 2080.

When the mast set position is less than the actual position, as determined by mast controller 3200 at decision block 4014, flow continues at decision block 4016.

At decision block 4016, if the actual mast position is close to the set position, drive control unit 3204 decelerates electric motor downward, block 4018. If the actual mast position is not close to the set position, drive control unit 3204 accelerates electric motor downward, block 4020.

When the mast set position not less than the actual position, as determined by mast controller 3200 at decision block 4014, drive control unit 3204 disables the motor 2040, stopping mast movement at block 4024.

The previous description of the embodiments is provided to enable any person skilled in the art to practice the invention. The various modifications to these embodiments will be readily apparent to those skilled in the art, and the generic principles defined herein may be applied to other embodiments without the use of inventive faculty. Thus, the present invention is not intended to be limited to the embodiments shown herein, but is to be accorded the widest scope consistent with the principles and novel features disclosed herein.

What is claimed is:

1. A telescoping mast comprising:

a mast housing, the mast housing being hollow and having an interior and an exterior;

a first telescoping section, nested within the interior of the mast housing, the first telescoping section having an upper end and a lower end and having an interior and an exterior;

a set of first upper pulleys affixed to the upper end of the mast housing;

a set of first lower pulleys affixed to the lower end of the first telescoping section;

a non-load-bearing cable, threaded through the first upper pulleys and first lower pulleys such that a first end of the non-load-bearing cable is attached to the mast housing;

wherein the non-load-bearing cable remains taut when the first telescoping section is raised or lowered; and, wherein the non-load-bearing cable is either electrical cable or optical cable.

2. The telescoping mast of claim 1, further comprising: a drive shaft attached to a bottom of the first telescoping section, the drive shaft configured to raise or lower the first telescoping section.

3. The telescoping mast of claim 2, further comprising: a motor coupled to the drive shaft, and configured to drive the drive shaft.

4. The telescoping mast of claim 3, further comprising: a second telescoping section, nested within the interior of the first telescoping section, the second telescoping section having an upper end and a lower end.

5. The telescoping mast of claim 4, further comprising: a position feedback sensor coupled to at least one of the telescoping sections, configured to identify a position of the telescoping sections; and a computation unit configured to control the motor based on the position of the telescoping sections.

6. The telescoping mast of claim 5, further comprising: a spring motor, coupled to the drive shaft, configured to rotate the drive shaft and store mechanical energy.

7. The telescoping mast of claim 6, wherein the motor is an electric motor.

8. The telescoping mast of claim 7, further comprising: an electrical energy storage unit, coupled to the electric motor, configured to supplement electrical power to the electric motor.

9. The telescoping mast of claim 8, wherein the computation unit further comprises: an application interface configured to read a set position input from a user of the telescoping mast.

10. The telescoping mast of claim 9, wherein the computation unit further comprises: a position monitor configured to receive the position of the telescoping sections from the position feedback sensor.

11. The telescoping mast of claim 10, wherein the computation unit further comprises: a drive control unit configured to decelerate the motor when the position of the telescoping sections is close to the set position, and accelerate the motor when the position of the telescoping sections is not close to the set position.

12. The telescoping mast of claim 11, further comprising: a receiver configured to receive the user interface image from an external source.

13. The telescoping mast of claim 12, wherein a second end of the non-load-bearing cable is attached to a connector at a top of the telescoping mast, the connector configured to be attached to a payload.

14. The telescoping mast of claim 13, wherein the payload is a camera.

15. The telescoping mast of claim 14, wherein the non-load-bearing cable provides power to the camera.

16. The telescoping mast of claim 14, wherein the non-load-bearing cable conducts image information from the camera.

17. The telescoping mast of claim 13, wherein the payload is a radio-frequency antenna.

18. The telescoping mast of claim 14, wherein the non-load-bearing cable provides power to the radio-frequency antenna.

19. The telescoping mast of claim 14, wherein the non-load-bearing cable conducts image information from the radio-frequency antenna.

20. A telescoping mast comprising:

a mast housing, the mast housing being hollow and having an interior and an exterior;

a first telescoping section, nested within the interior of the mast housing, the first telescoping section having an upper end and a lower end and having an interior and an exterior;

a set of first upper pulleys affixed to the upper end of the mast housing;

a set of first lower pulleys affixed to the lower end of the first telescoping section;

a second telescoping section, nested within the interior of the first telescoping section, the second telescoping section having an upper end and a lower end and having an interior and an exterior;

a third telescoping section, nested within the interior of the second telescoping section, the third telescoping section having an upper end and a lower end;

a non-load-bearing cable, threaded through the first upper pulleys and the first lower pulleys, such that a first end of the non-load-bearing cable is attached to the mast housing, the non-load-bearing cable being either electrical cable or optical cable;

wherein the cable remains taut when the first, second, or third telescoping sections are raised or lowered; and wherein a second end of the non-load-bearing cable is attached to a connector at a top of the telescoping mast, the connector configured to be attached to a payload.

* * * * *